US008284105B2

(12) United States Patent
Mao et al.

(10) Patent No.: US 8,284,105 B2
(45) Date of Patent: Oct. 9, 2012

(54) MULTI-BAND MICROSTRIP MEANDER-LINE ANTENNA

(75) Inventors: Shau-Gang Mao, Taipei (TW); Wei-Kung Deng, Taipei (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 430 days.

(21) Appl. No.: 12/606,168

(22) Filed: Oct. 26, 2009

(65) Prior Publication Data

US 2011/0025576 A1 Feb. 3, 2011

(30) Foreign Application Priority Data

Jul. 30, 2009 (TW) ..... 98125670 A

(51) Int. Cl.
*H01Q 1/38* (2006.01)

(52) U.S. Cl. ..... 343/700 MS; 343/895

(58) Field of Classification Search ..... 343/700, 343/843, 895

See application file for complete search history.

(56) References Cited

U.S. PATENT DOCUMENTS

| | | | | |
|---|---|---|---|---|
| 4,475,107 | A * | 10/1984 | Makimoto et al. | 343/700 MS |
| 4,477,815 | A * | 10/1984 | Brunner et al. | 343/756 |
| 6,417,816 | B2 * | 7/2002 | Sadler et al. | 343/795 |
| 6,791,497 | B2 * | 9/2004 | Winebrand et al. | 343/702 |
| 7,365,688 | B2 * | 4/2008 | Tseng et al. | 343/700 MS |
| 7,456,798 | B2 * | 11/2008 | Wong et al. | 343/742 |
| 2002/0080088 | A1 * | 6/2002 | Boyle | 343/895 |

* cited by examiner

*Primary Examiner* — Tho G Phan
(74) *Attorney, Agent, or Firm* — Winston Hsu; Scott Margo

(57) ABSTRACT

A multi-band microstrip meander-line antenna includes a substrate, two meander-shaped conductors, and two feed lines. The first meander-shaped conductor is disposed on the substrate in a first reciprocating bend manner for providing a resonant frequency band corresponding to a first operating frequency. The second meander-shaped conductor is disposed on the substrate in a second reciprocating bend manner for providing a resonant frequency band corresponding to a second operating frequency. The first feed line includes the first end electrically connected to a first feed point of the antenna and the second end electrically connected to the end of the first meander-shaped conductor. The second feed line includes the first end electrically connected to the second feed point of the antenna and the second end electrically connected to the end of the second meander-shaped conductor.

55 Claims, 14 Drawing Sheets

MULTI-BAND MICROSTRIP MEANDER-LINE ANTENNA

BACKGROUND OF THE INVENTION

1. Field of the Invention

The present invention is related to a microstrip meander-line antenna, and more particularly, to a multi-band microstrip meander-line antenna for a wireless communication system.

2. Description of the Prior Art

With rapid development in wireless communication technology, portable electronic devices, such as mobile phones, notebook computers or personal digital assistants (PDAs), can receive and transmit wireless signals using built-in antennas. When connected to WWAN (wireless wide area network) for data transfer, the user of these portable devices can surf the Internet or check personal emails.

A well-designed antenna can enhance the efficiency, sensitivity and reliability of the wireless communication system. Currently, there are three main types of antennas used in a mobile communication system: patch antennas, ceramic antennas, and microstrip meander-line antenna. The patch antenna has narrow bandwidth and low transmission efficiency. The ceramic antenna is expensive and its specific absorption rate (SAR) has not yet qualified current electromagnetic regulations. The microstrip meander-line antenna has wider bandwidth (>10%) and can be integrated into circuit boards without extra welding procedures, thereby capable of reducing manufacturing costs.

On the other hand, the operating frequency of different wireless communication system may vary. For example, the operating frequency of a Wi-Fi (Wireless Fidelity) system is around 2.4 GHz-2.4835 GHz and 4.9 GHz-5.875 GHz; the operating frequency of a WiMAX (Worldwide Interoperability for Microwave Access) system is around 2.3 GHz-2.69 GHz, 3.3 GHz-3.8 GHz and 5.25 GHz-5.85 GHz; the operating frequency of a WCDMA (Wideband Code Division Multiple Access) system is around 1850 MHz-2025 MHz; the operating frequency of a GSM (Global System for Mobile communications) 1900 system is around 1850 MHz-1990 MHz. In the ideal case, multiple frequency bands can be provided using a single antenna, so that the user can conveniently access various wireless communication systems. Also, the size of the antenna should be as small as possible, especially when used in portable electronic devices.

SUMMARY OF THE INVENTION

The present invention includes a multi-band microstrip meander-line antenna comprising a substrate; a first meander-shaped conductor disposed on the substrate in a first reciprocating bend manner for providing a resonant frequency band corresponding to a first frequency; a second meander-shaped conductor disposed on the substrate in a second reciprocating bend manner for providing a resonant frequency band corresponding to a second frequency; a first feed line having a first end electrically connected to a first feed point of the antenna and a second end electrically connected to an end of the first meander-shaped conductor; and a second feed line having a first end electrically connected to a second feed point of the antenna and a second end electrically connected to an end of the second meander-shaped conductor.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. As one skilled in the art will appreciate, manufacturers may refer to a component by different names. This document does not intend to distinguish between components that differ in name but in function. In the following discussion and in the claims, the terms "include", "including", "comprise", and "comprising" are used in an open-ended fashion, and thus should be interpreted to mean "including, but not limited to . . . ". Also, the term "electrically connect" is intended to mean either a direct or an indirect electrical connection. Accordingly, if one device is electrically connected to another device, the electrical connection may be through a direct electrical connection, or through an indirect electrical connection via other devices and connections.

Figure 1:
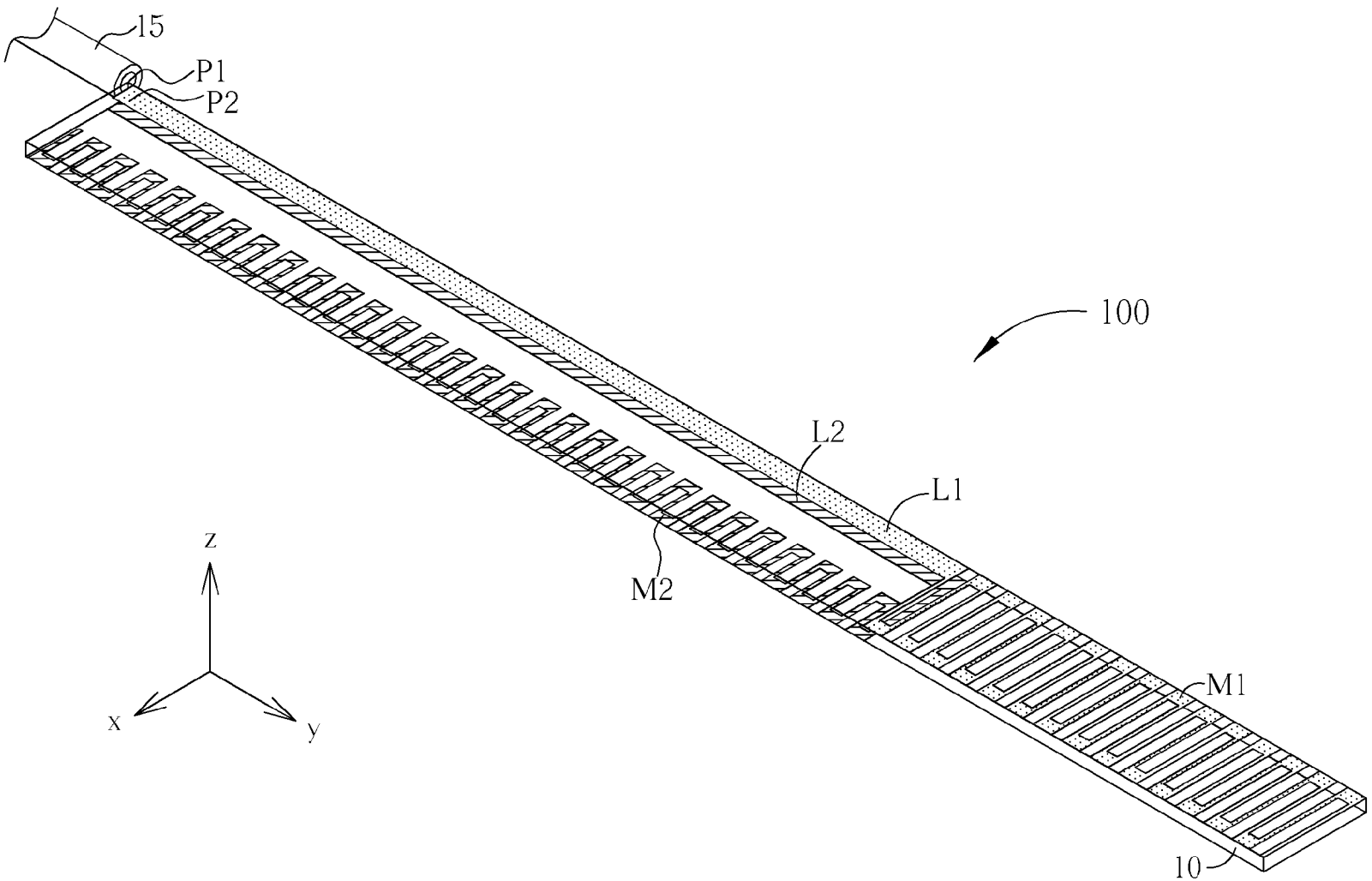
FIG. 1 is a 3-dimensional diagram illustrating a dual-band antenna according to a first embodiment of the present invention.

Reference is made to FIG. 1 for a 3-dimensional diagram illustrating a dual-band antenna 100 according to a first embodiment of the present invention. The dual-band antenna 100 includes a substrate 10, two meander-shaped conductors M1 and M2, and two feed lines L1 and L2. By receiving the signals fed from a coaxial cable 15 at two feed points P1 and P2, the dual-band antenna 100 can provide two resonant frequency bands F1 and F2. In the first embodiment of the present invention, the substrate 10 is a rectangular-shaped substrate comprising dielectric, ceramic, glass, magnetic, high molecule material, or composite material made of the above-mentioned materials. The substrate 10 can be a rigid printed circuit board (RPCB) as illustrated in FIG. 1, or a flexible printed circuit board (FPCB) capable of changing shape. The meander-shaped conductor M1, disposed on the top surface of the substrate 10 in a reciprocating bend manner, is electrically connected to the feed point P1 via the feed line L1. The meander-shaped conductor M2, disposed on the bottom surface of the substrate 10 in a reciprocating bend manner, is electrically connected to the feed point P2 via the feed line L2. The meander-shaped conductors M1, M2 and the feed lines L1, L2 can include conductive metal material or alloy made thereof, such as gold, silver, copper or aluminum. The meander-shaped conductors M1, M2 and the feed lines L1, L2 can be fabricated using printed-circuit technology in which metal material or alloy is printed onto the substrate 10. Or, reciprocating bend patterns can be formed by etching metal material or alloy which has been attached to the substrate 10.

Figure 2A:
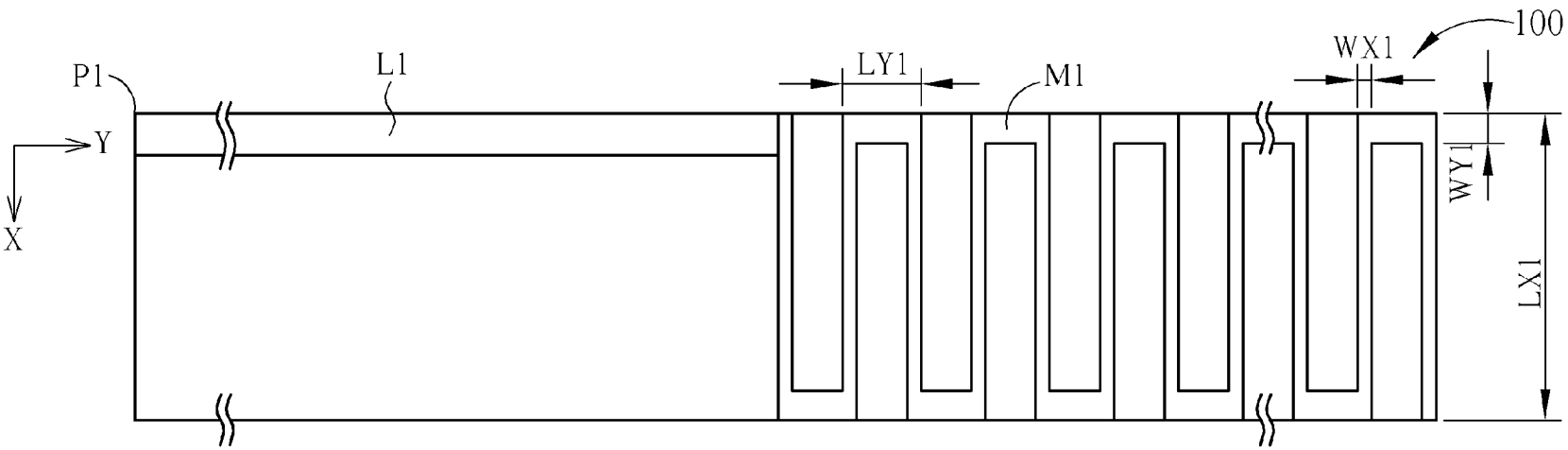
FIGS. 2*a* and 2*b* are planar diagrams of the dual-band antenna in FIG. 1.
Figure 2B:
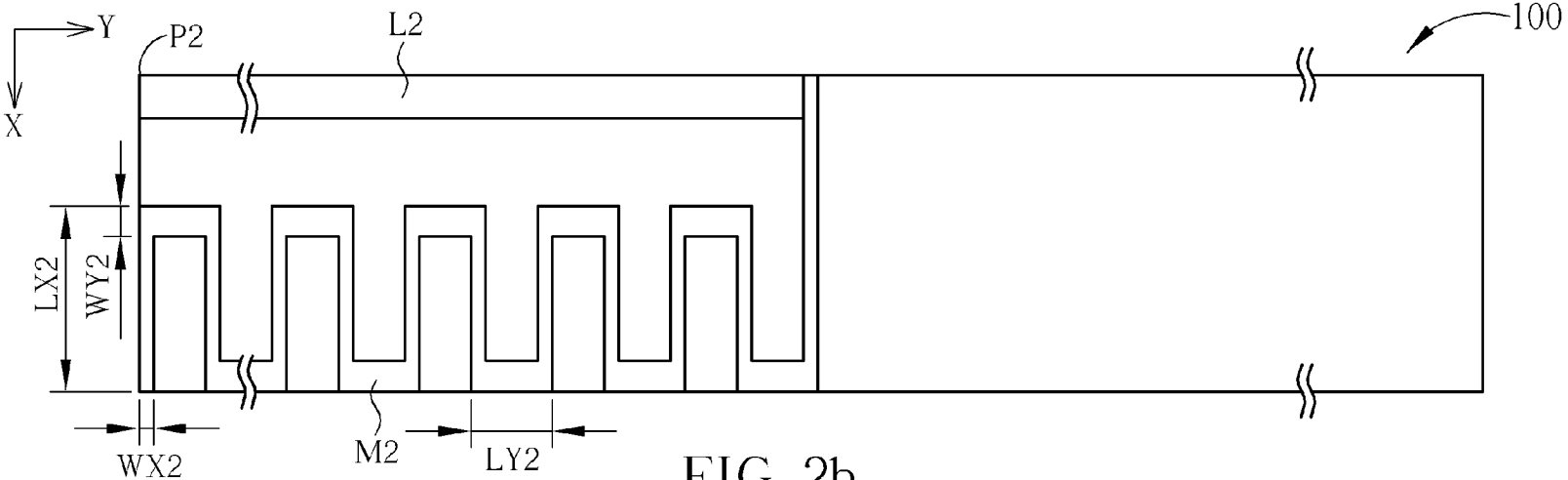

For further illustration of the present invention, references are made to FIGS. 2*a* and 2*b* for planar diagrams of the dual-band antenna 100. FIG. 2*a* is a top-view diagram of the dual-band antenna 100, while FIG. 2*b* is a bottom-view diagram of the dual-band antenna 100. In the dual-band antenna 100 according to the first embodiment of the present invention, LX1 and WX1 respectively represent the length and width of the meander-shaped conductor M1 disposed along the direction perpendicular to signal polarization (X axis), while LY1 and WY1 respectively represent the length and width of the meander-shaped conductor M1 disposed along the direction parallel to signal polarization (Y axis); LX2 and WX2 respectively represent the length and width of the meander-shaped conductor M2 disposed along the direction perpendicular to signal polarization (X axis), while LY2 and WY2 respectively represent the length and width of the meander-shaped conductor M2 disposed along the direction parallel to signal polarization (Y axis). In this embodiment, the meander-shaped conductors M1 and M2 both have a periodically-varying zigzag pattern with fixed reciprocating widths (LY1 and LY2 remain unchanged). The number of bending in the patterns of the meander-shaped conductors M1 and M2 are represented by m and n. Therefore, the overall length S1 of the meander-shaped conductor M1 is about m*(LX1+LY1), while the overall length S2 of the meander-shaped conductor M2 is about n*(LX2+LY2).

The overall length of a meander-shaped conductor (S1 or S2) needs to be an integer multiple of a quarter wavelength of a frequency for generating a corresponding resonant frequency. The bandwidth of the dual-band antenna 100 increases with the reciprocating width (LY1 or LY2) of the meander-shaped conductor. Also, the radiation efficiency of the dual-band antenna 100 can be improved by increasing the width (WY1 or WY2) of the meander-shaped conductor disposed along the direction parallel to signal polarization (Y axis). Therefore, the length, width and reciprocating width of the meander-shaped conductors can be determined according to different operating frequencies. For a dual-band system with two operating frequencies F1 and F2 whose signal wavelengths are respectively represented by λ1 and λ2, the meander-shaped conductors M1 and M2 both have equally-spaced zigzag patterns in which the length of the meander-shaped conductor M1 disposed along the X axis is larger than that disposed along the Y axis (LX1>LY1), the length of the meander-shaped conductor M2 disposed along the X axis is larger than that disposed along the Y axis (LX2>LY2), the length of the meander-shaped conductor M1 disposed along the X axis is larger than the length of the meander-shaped conductor M2 disposed along the X axis (LX1>LX2), the length of the meander-shaped conductor M1 disposed along the Y axis is equal to the length of the meander-shaped conductor M2 disposed along the Y axis (LY1=LY2), and the number of reciprocation in the meander-shaped conductor M1 is fewer than the number of reciprocation in the meander-shaped conductor M2 (m<n). Therefore, the overall length of the meander-shaped conductor M1 is different from the overall length of the meander-shaped conductor M2 (S1≠S2), in which S1 is an odd multiple of (¼) λ1 and S2 is an odd multiple of (¼) λ2. As a result, the meander-shaped conductors M1 and M2 can be electrically connected to the feed points P1 and P2 respectively via the feed lines L1 and L2 for providing two distinct resonant frequency bands F1 and F2 when applied in a dual-band wireless communication system.

Since the meander-shaped conductors M1 and M2 are disposed on the substrate 10 in a reciprocating bend manner, the required overall length along the Y-axis is about (N1*LY1+N2*LY2), which is far shorter than the sum of the actual overall length of the two meander-shaped conductors (m*(LX1+LY1)+n*(LX2+LY2)). Therefore, the size of the antenna can be largely reduced. Meanwhile, in order to prevent power offset in the far-field caused by the currents flowing through the meander-shaped conductors M1 and M2 in opposite directions, the present invention improves the efficiency of the antenna by increasing the width of the meander-shaped conductors M1 and M2 disposed along the direction parallel to signal polarization (Y-axis) so that WY1>WX1 and WY2>WX2. Meanwhile, the feed lines L1 and L2 are broadside coupled strip-lines respectively disposed along the wide sides of the upper and lower surfaces of the substrate 10, and extend from the central signal feed-in location of the dual-band 100 to the narrow side of the substrate 10 along the direction parallel to signal polarization. Therefore, the dual-band antenna 100 according to the present invention is advantageous in flexible integration into other circuits, better mechanical robustness, and the ability to improve impedance matching and radiation efficiency by adjusting the impedance of the broadside coupled strip-lines.

Figure 3:
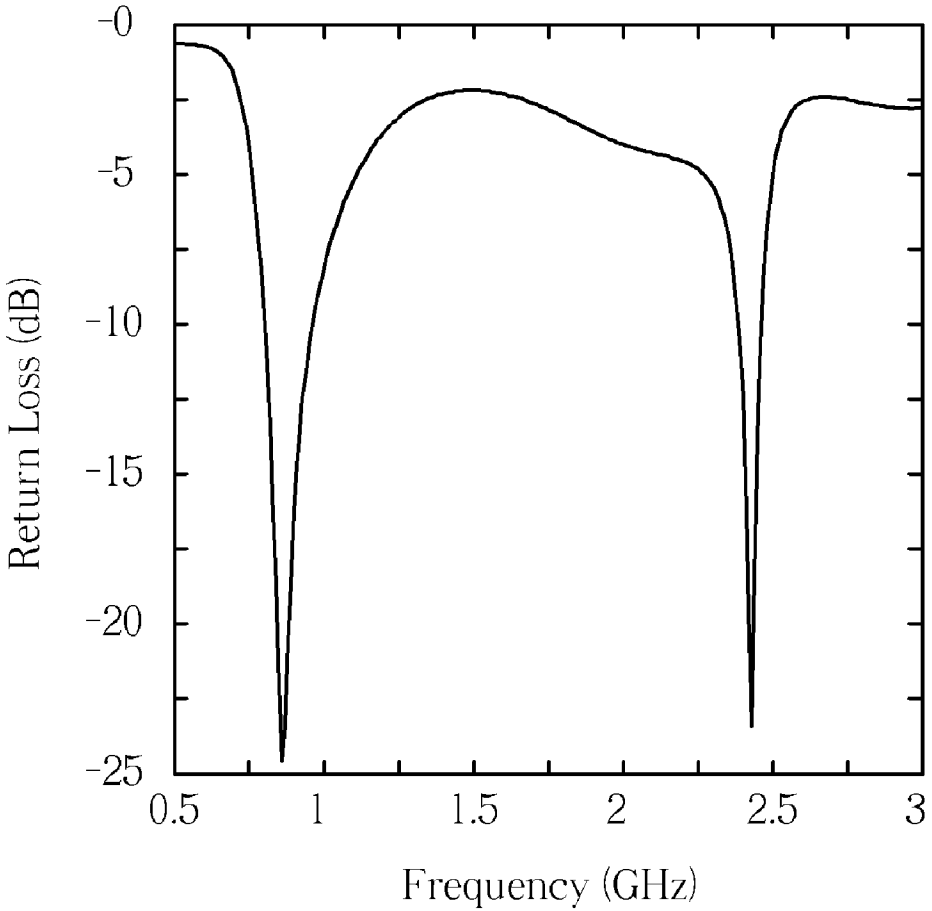
FIG. 3 is a diagram illustrating the return loss of the dual-band antenna in FIG. 1.

Reference is made to FIG. 3 for a diagram illustrating the return loss of the dual-band antenna 100 according to the present invention under the assumption that the dielectric coefficient ϵ of the substrate 10 is equal to 4.4, the dielectric loss tan δ of the substrate 10 is equal to 0.02, the thickness of the substrate 10 is 0.6 mm, the metal thickness of the meander-shaped conductors M1 and M2 is 35 μm, and the overall circuit layout area is 60 μm×5 μm. In FIG. 3, the vertical axis represents the amount of return loss in dB, while the horizontal axis represents the operating frequency in GHz. As depicted in FIG. 3, the reflection coefficients of the dual-band antenna 100 at low frequency (around 900 MHz) and at high frequency (around 2400 MHz) are both smaller than −20 dB. With good impedance match, the present invention can provide two resonant frequency bands at 900 MHz and 2400 MHz.

Figure 4A:
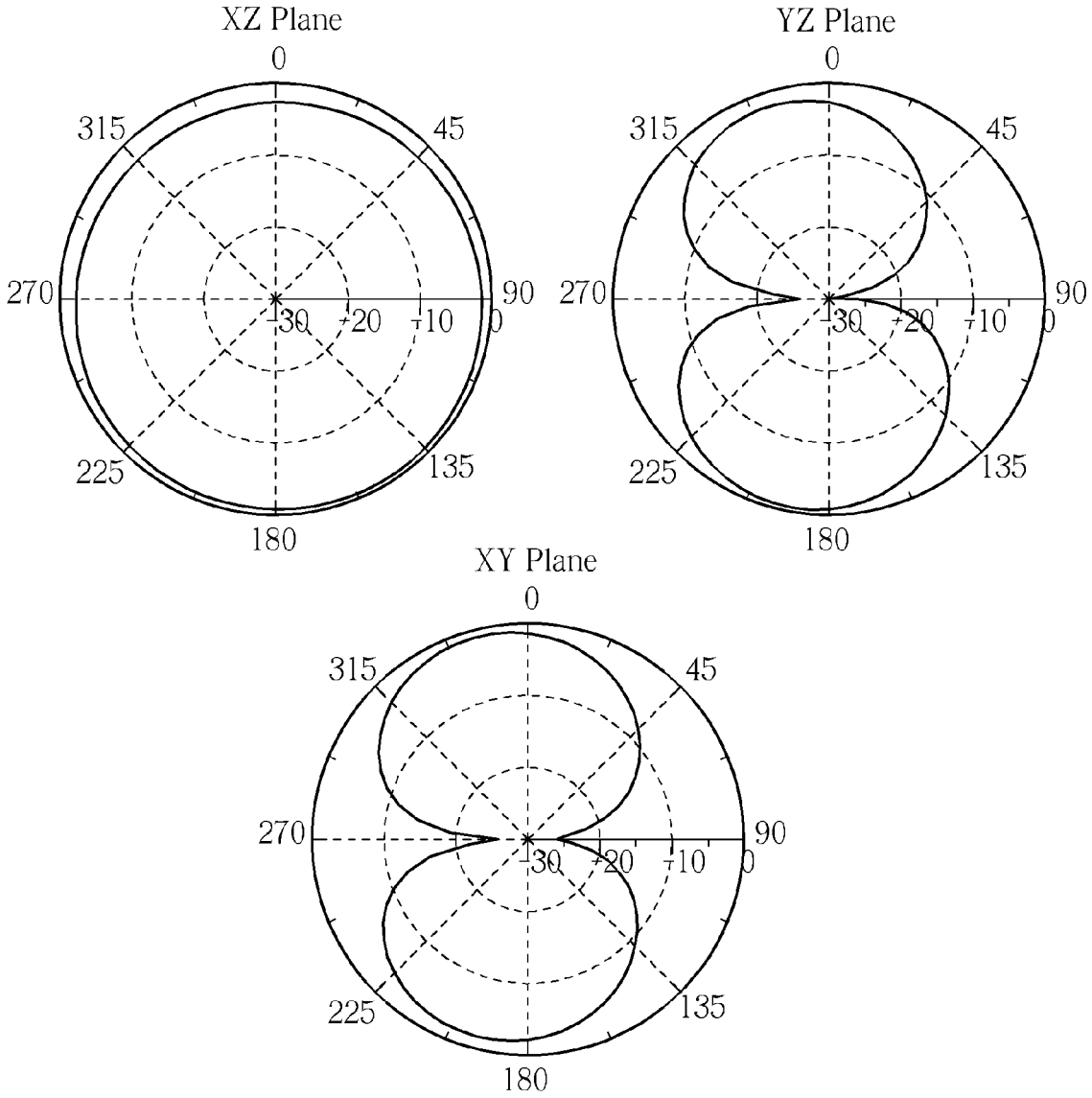
FIGS. 4*a* and 4*b* are diagrams illustrating the radiation field of the dual-band antenna in FIG. 1.
Figure 4B:
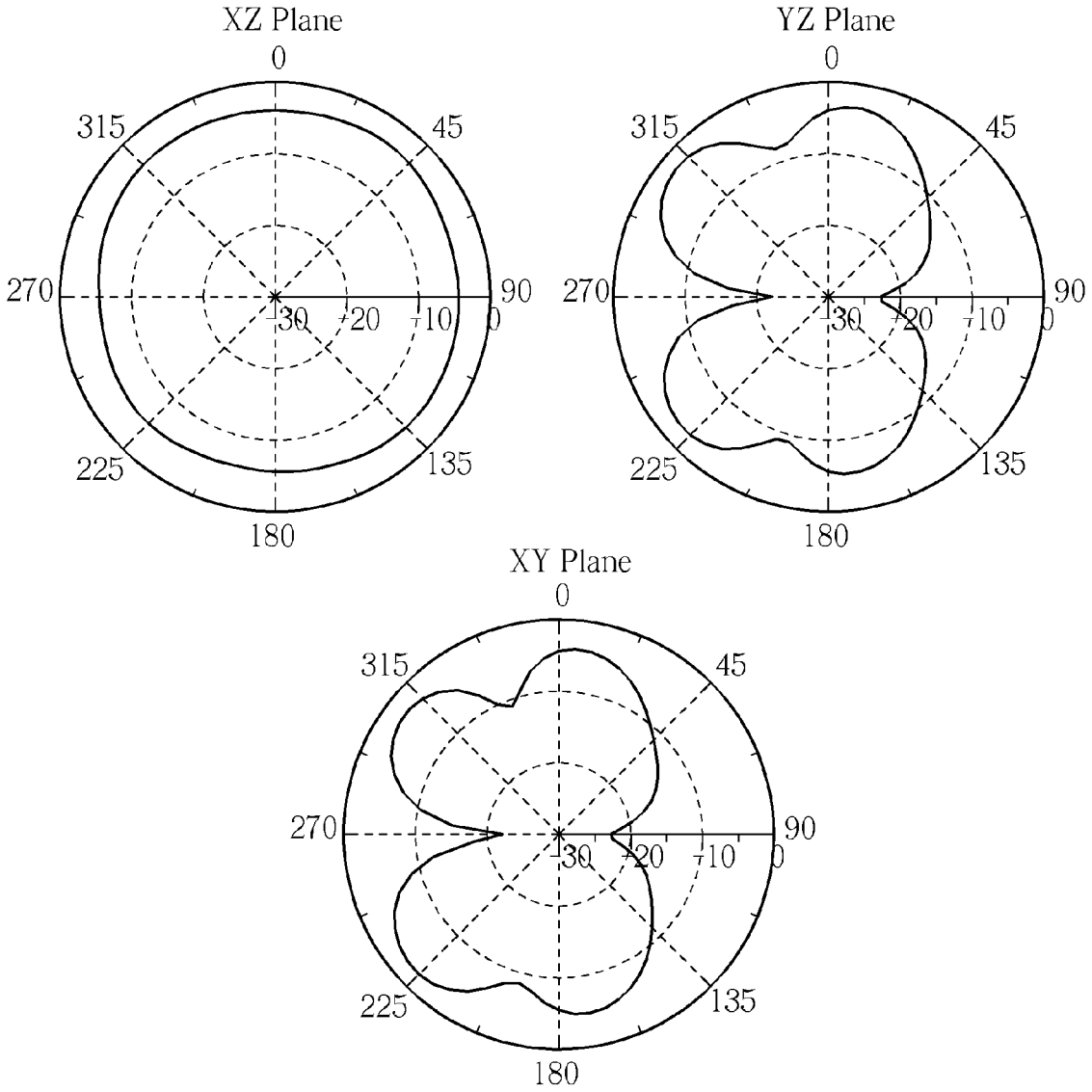

FIG. 4*a* is a diagram illustrating the radiation field of the dual-band antenna 100 along the XZ, YZ and XY planes when the operating frequency is 910 MHz. FIG. 4*b* is a diagram illustrating the radiation field of the dual-band antenna 100 along the XZ, YZ and XY planes when the operating frequency is 2400 MHz. As depicted in FIGS. 4*a* and 4*b*, the dual-band antenna 100 according to the present invention can provide omni-directional radiation field.

Figure 5A:
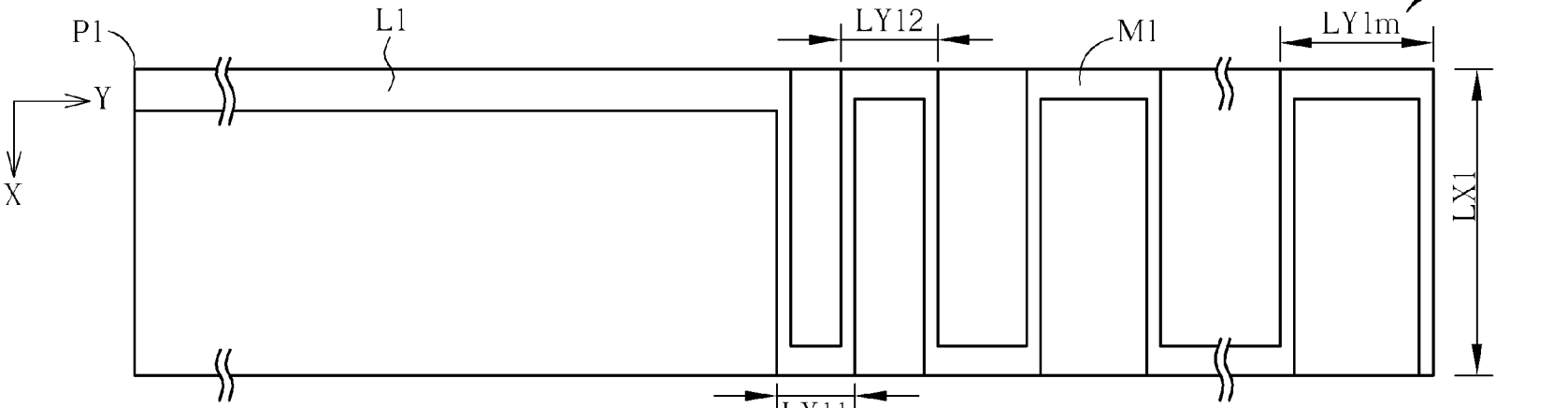
FIGS. 5*a* and 5*b* are planar diagrams of a dual-band antenna according to a second embodiment of the present invention.
Figure 5B:
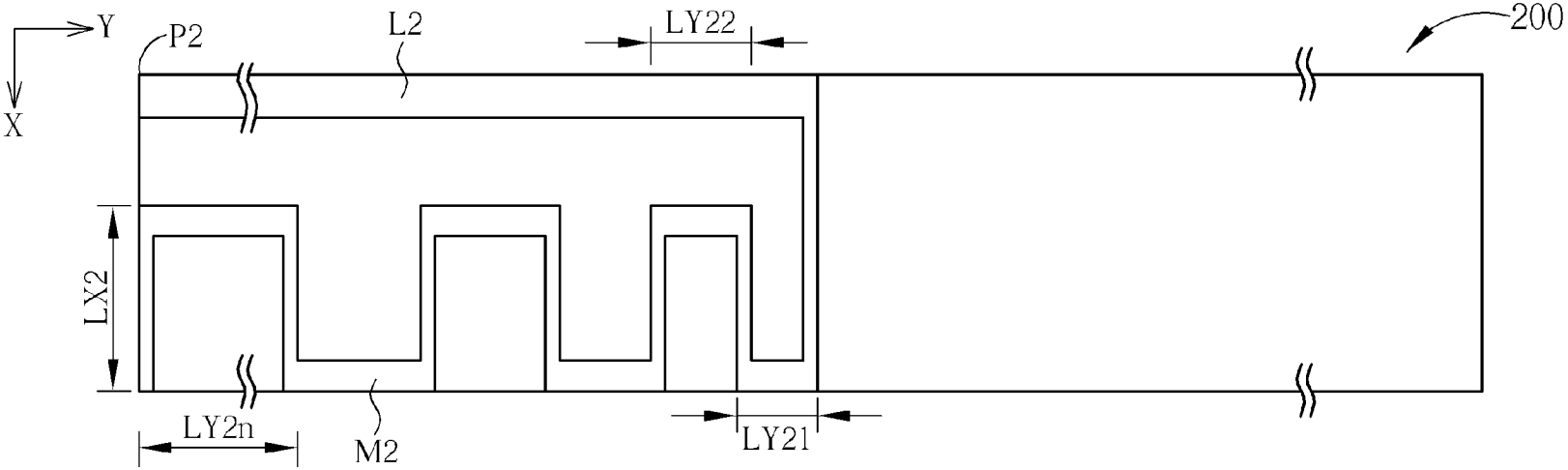
Figure 6A:
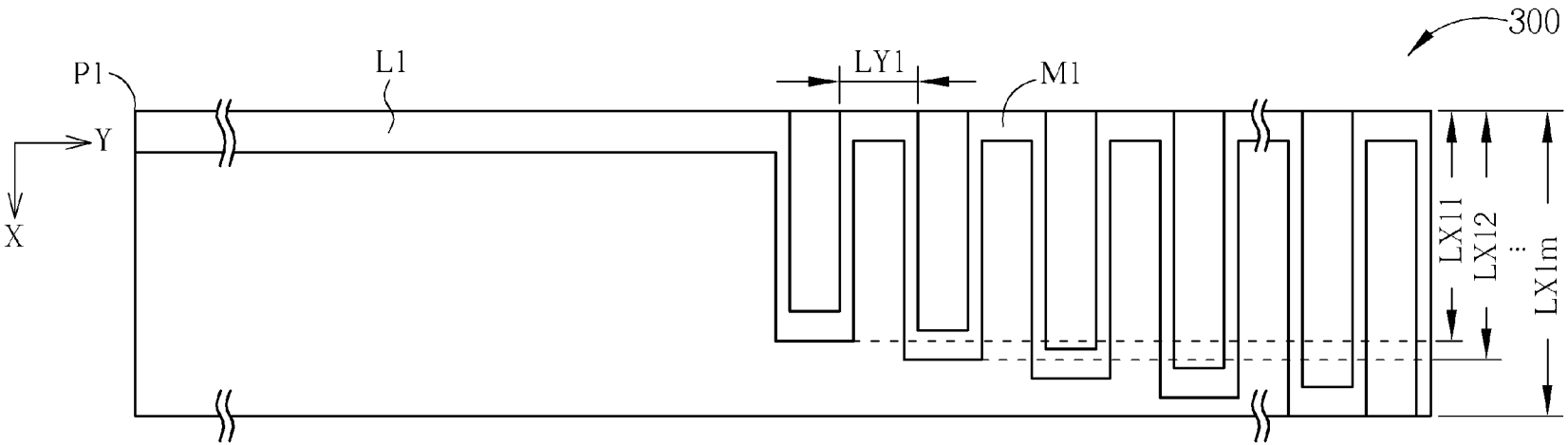
FIGS. 6*a* and 6*b* are planar diagrams of a dual-band antenna according to a third embodiment of the present invention.
Figure 6B:
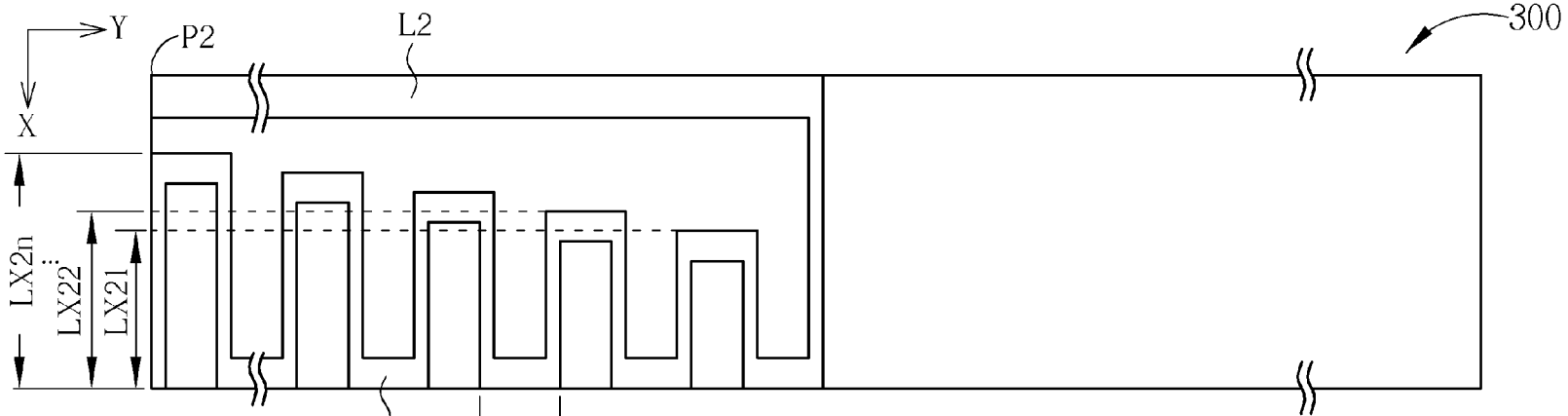

According to different applications, the meander-shaped conductors can be disposed on the substrate in various reciprocating bend manner, thereby capable of providing different operating frequencies by changing the length, the width and the reciprocating width of the meander-shaped conductors. References are made to FIGS. 5*a* and 5*b* for planar diagrams of a dual-band antenna 200 according to a second embodiment of the present invention. FIG. 5*a* is a top-view diagram of the dual-band antenna 200, while FIG. 5*b* is a bottom-view diagram of the dual-band antenna 200. Similar to the dual-band antenna 100 according to the first embodiment of the present invention, the meander-shaped conductor M1 and the feed line L1 of the dual-band antenna 200 are both disposed on the top surface of the substrate 10, and the meander-shaped conductor M2 and the feed line L2 of the dual-band antenna 200 are both disposed on the bottom surface of the substrate 10. However, the dual-band antenna 200 differs from the dual-band antenna 100 in that the meander-shaped conductors M1 and M2 have different reciprocating widths. In the second embodiment of the present invention, the meander-shaped conductors M1 and M2 both have a zigzag pattern with varying reciprocating widths. Along the direction perpendicular to signal polarization (X axis), the meander-shaped conductor M1 includes multiple sections with an identical length LX1; along the direction parallel to signal polarization (Y axis), the meander-shaped conductor M1 includes multiple sections with completely different or partly different lengths LY11-LY1*m*. In the embodiment illustrated in FIG. 5*a*, the segment length of the meander-shaped conductor M1 along the direction parallel to signal polarization (Y axis) increases with each reciprocation (LY11<LY12< . . . <LY1*m*). Similarly, along the direction perpendicular to signal polarization (X axis), the meander-shaped conductor M2 includes multiple sections with an identical length LX2; along the direction parallel to signal polarization (Y axis), the meander-shaped conductor M2 includes multiple sections with completely different or partly different lengths LY11-LY1*m*. In the embodiment illustrated in FIG. 5*b*, the segment length of the meander-shaped conductor M2 along the direction parallel to signal polarization (Y axis) increases with each reciprocation (LY21<LY22< . . . <LY2*n*). In the second embodiment of the present invention, the overall lengths S1 and S2 of the conductors are determined according to the operating frequencies F1 and F2 of the dual-band wireless communication system. Next, the values of LX1, LX2, LY11-LY1*m*, LY21-LY2*n*, *m* and *n* can thus be determined accordingly. By disposing the meander-shaped conductors M1 and M2 in a reciprocating bend manner, the present invention can reduce the size of the antenna.

Figure 7A:
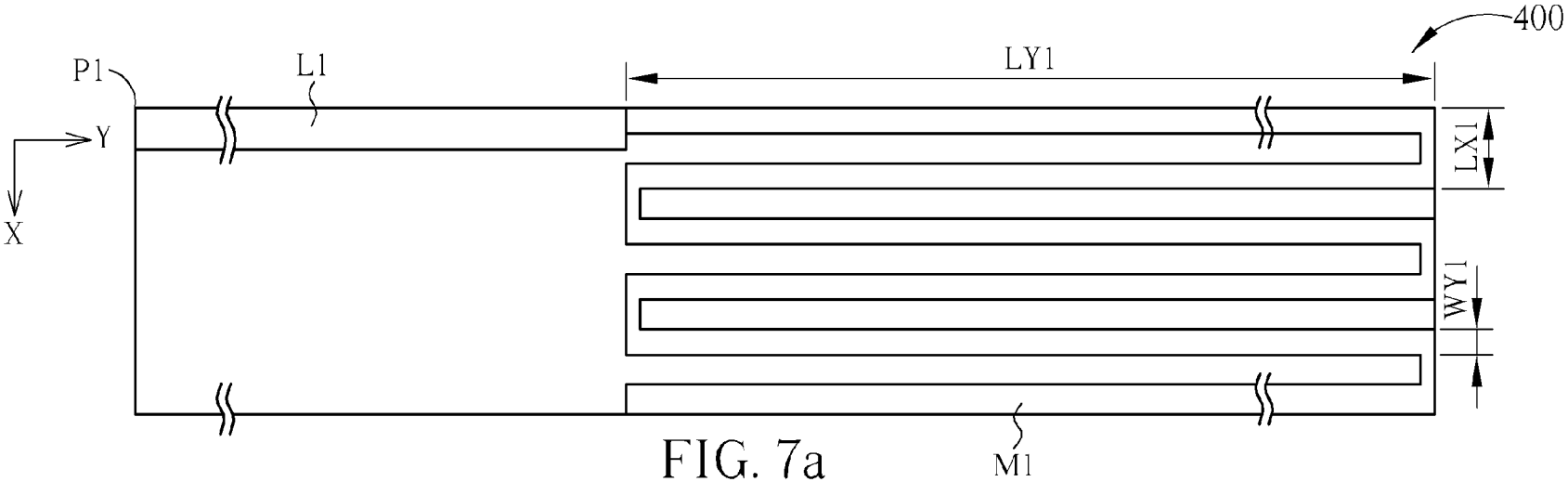
FIGS. 7*a* and 7*b* are planar diagrams of a dual-band antenna according to a fourth embodiment of the present invention.
Figure 7B:
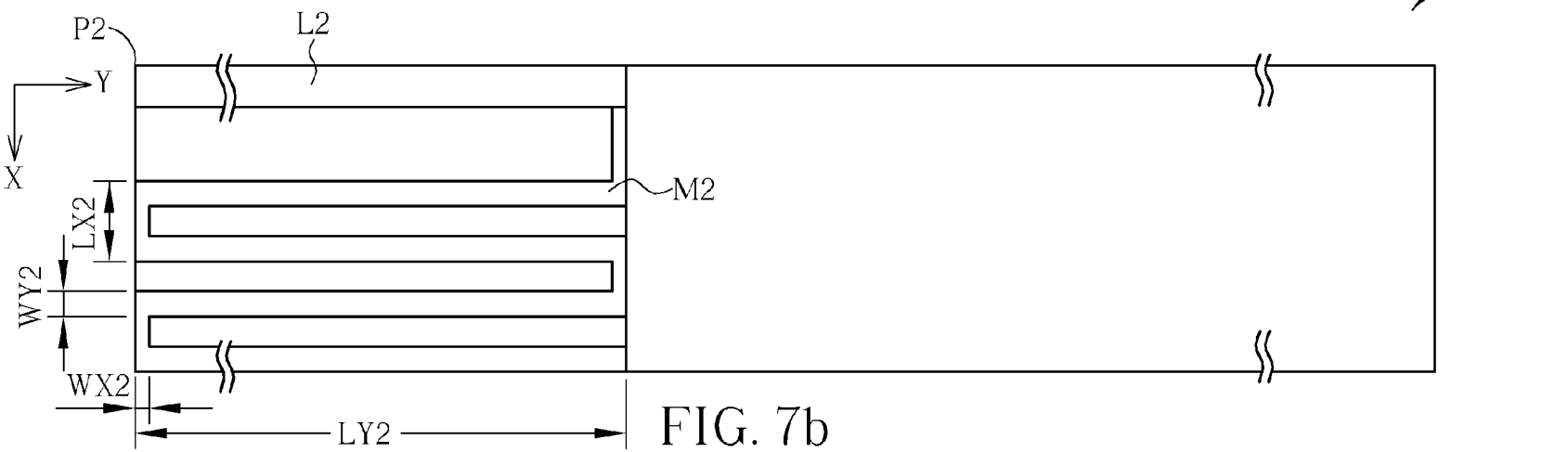

References are made to FIGS. 7*a* and 7*b* for planar diagrams of a dual-band antenna 400 according to a fourth embodiment of the present invention. FIG. 7*a* is a top-view diagram of the dual-band antenna 400, while FIG. 7*b* is a bottom-view diagram of the dual-band antenna 400. Similar to the dual-band antenna 100 according to the first embodiment of the present invention, the meander-shaped conductor M1 and the feed line L1 of the dual-band antenna 400 are both disposed on the top surface of the substrate 10, and the meander-shaped conductor M2 and the feed line L2 of the dual-band antenna 200 are both disposed on the bottom surface of the substrate 10. However, the dual-band antenna 400 differs from the dual-band antenna 100 in that the meander-shaped conductors M1 and M2 have different reciprocating patterns. In the third embodiment of the present invention, the meander-shaped conductors M1 and M2 both have equally-spaced zigzag patterns in which the length of the meander-shaped conductor M1 disposed along the X axis is smaller than that disposed along the Y axis (LX1<LY1), the length of the meander-shaped conductor M2 disposed along the X axis is smaller than that disposed along the Y axis (LX2<LY2), the length of the meander-shaped conductor M1 disposed along the X axis is equal to the length of the meander-shaped conductor M2 disposed along the X axis (LX1=LX2), the length of the meander-shaped conductor M1 disposed along the Y axis is larger than the length of the meander-shaped conductor M2 disposed along the Y axis (LY1>LY2), and the number of reciprocation in the meander-shaped conductor M1 is more than the number of reciprocation in the meander-shaped conductor M2 (m>n). Therefore, the overall length of the meander-shaped conductor M1 is different from the overall length of the meander-shaped conductor M2 (S1·S2), in which S1 is an odd multiple of (¼)λ1 and S2 is an odd multiple of (¼)λ2. As a result, the overall lengths S1 and S2 of the conductors can be determined according to the operating frequencies F1 and F2 of the dual-band wireless communication system. Next, the values of LX1, LX2, LY1, LY21, m and n can thus be determined accordingly. By disposing the meander-shaped conductors M1 and M2 in a reciprocating bend manner, the present invention can reduce the size of the antenna.

Figure 8A:
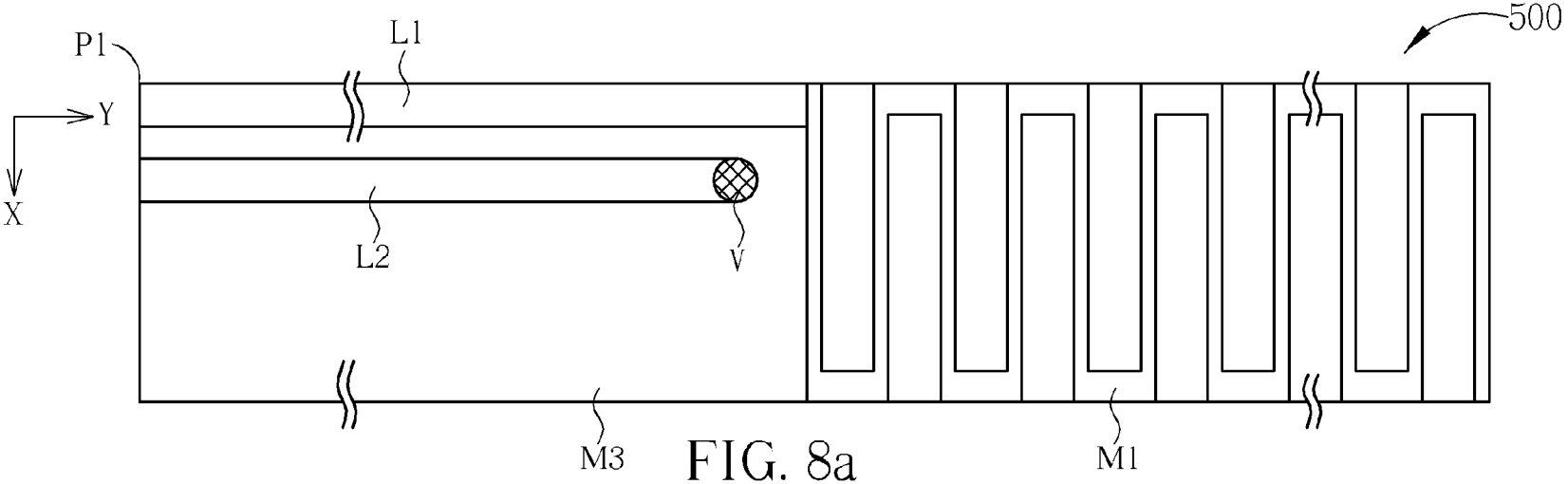
FIGS. 8*a* and 8*b* are planar diagrams of a dual-band antenna according to a fifth embodiment of the present invention.
Figure 8B:
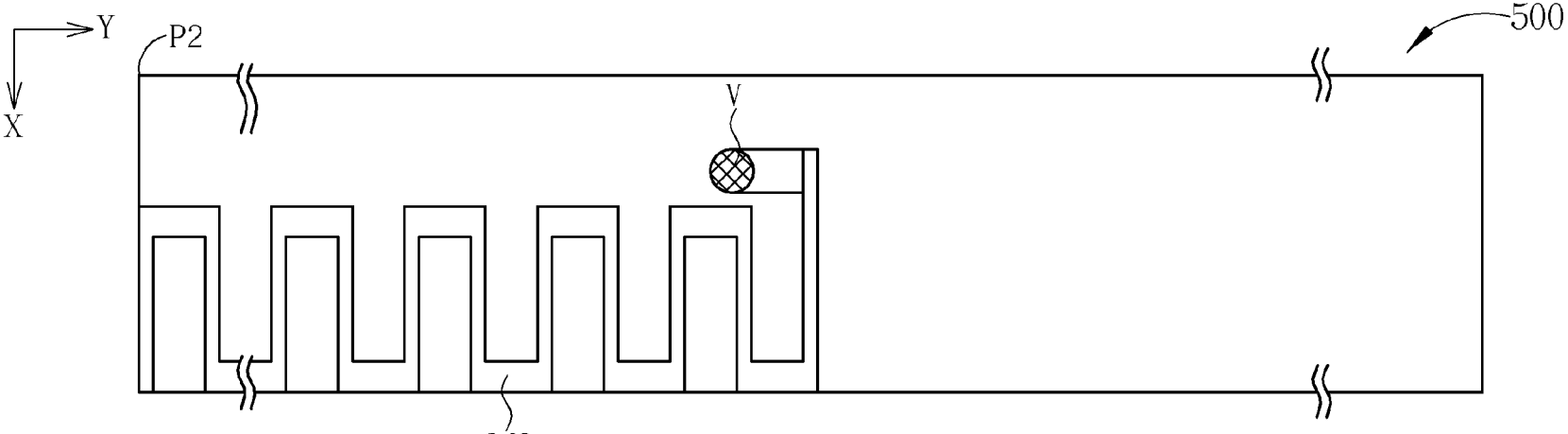

In the first through fourth embodiments of the present invention, the meander-shaped conductor M1 and the corresponding feed line L1 of the dual-band antennas 100-400 are both disposed on one surface of the substrate 10, while the meander-shaped conductor M2 and the corresponding feed line L2 of the dual-band antennas 100-400 are disposed on another surface of the substrate 10. However, the meander-shaped conductor and its corresponding feed line can be disposed on different surfaces of the substrate 10. References are made to FIGS. 8*a* and 8*b* for planar diagrams of a dual-band antenna 500 according to a fifth embodiment of the present invention. FIG. 8*a* is a top-view diagram of the dual-band antenna 500, while FIG. 8*b* is a bottom-view diagram of the dual-band antenna 500. Compared to the dual-band antennas 100-400 according to the first through fourth embodiments of the present invention, the meander-shaped conductor M1 and the feed lines L1, L2 of the dual-band antenna 500 are disposed on the top surface of the substrate 10, and the meander-shaped conductor M2 and is disposed on the bottom surface of the substrate 10. The dual-band antenna 500 further includes a via hole V which connects the top and bottom surfaces of the substrate 10. Therefore, the feed line L2 disposed on the top surface of the substrate 10 can be electrically connected to the meander-shaped conductor M2 disposed on the bottom surface of the substrate 10 through the via hole V. In FIGS. 8*a* and 8*b*, the meander-shaped conductors M1 and M2 of the dual-band antenna 500 are disposed in the reciprocating bend manner as depicted in FIGS. 1*a* and 1*b*, but can also be disposed in the reciprocating bend manners as depicted in FIGS. 5*a*-7*a* and 5*b*-7*b*, or in other reciprocating bend manners.

Figure 9A:
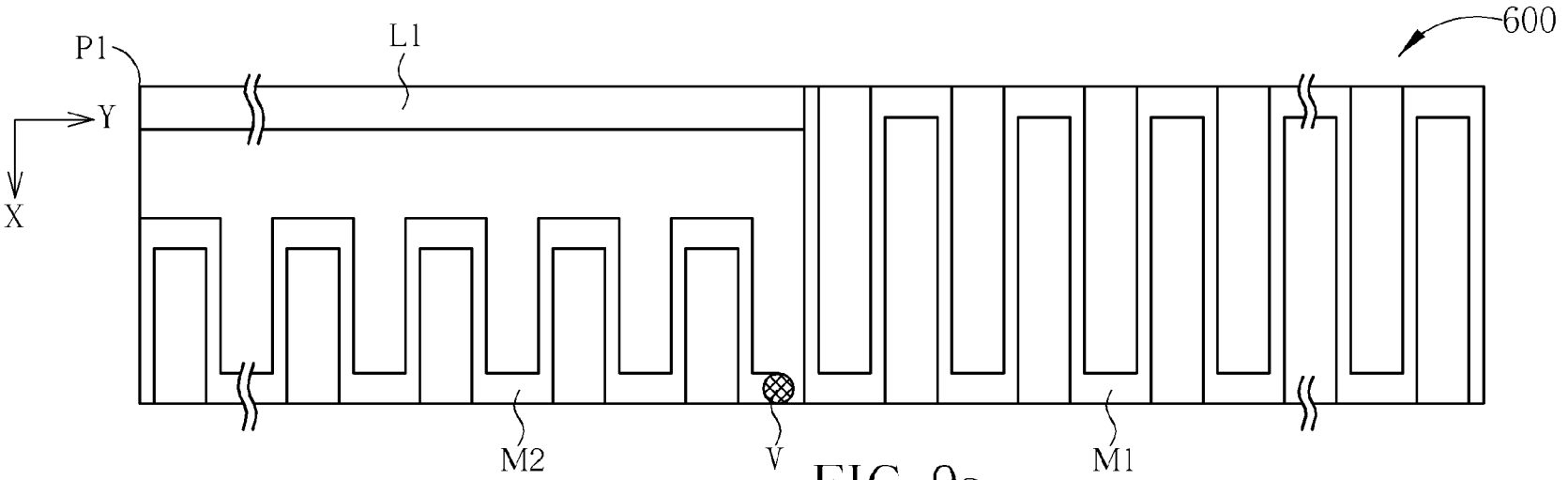
FIGS. 9*a* and 9*b* are planar diagrams of a dual-band antenna according to a sixth embodiment of the present invention.
Figure 9B:
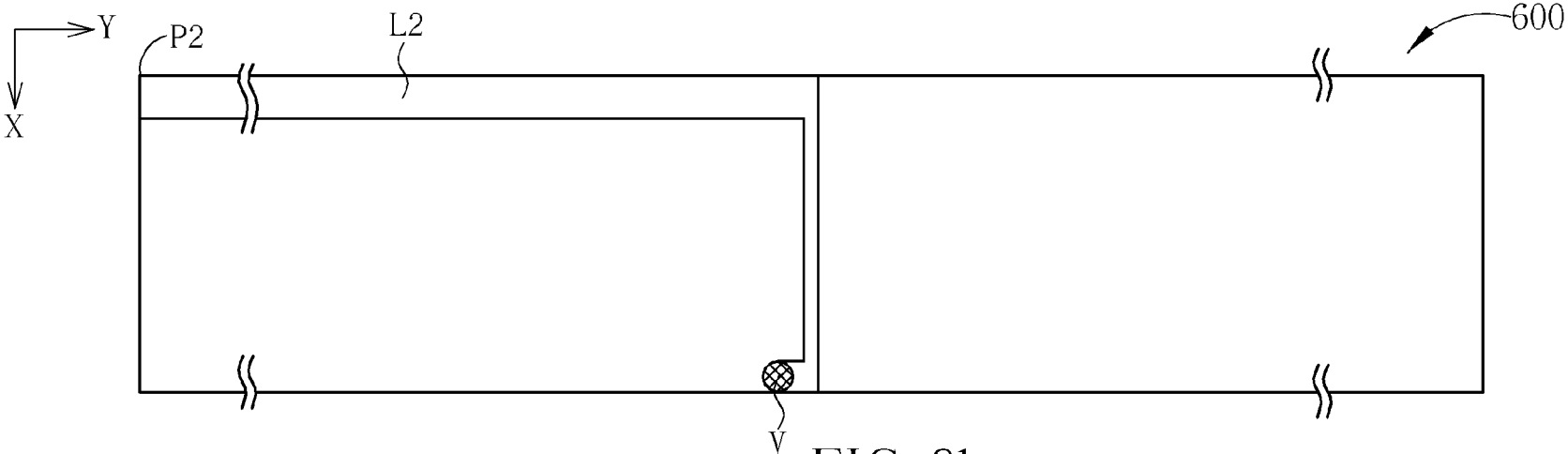

References are made to FIGS. 9*a* and 9*b* for planar diagrams of a dual-band antenna 600 according to a sixth embodiment of the present invention. FIG. 9*a* is a top-view diagram of the dual-band antenna 600, while FIG. 9*b* is a bottom-view diagram of the dual-band antenna 600. Compared to the dual-band antennas 100-400 according to the first through fourth embodiments of the present invention, the meander-shaped conductors M1, M2 and the feed line L1 of the dual-band antenna 600 are disposed on the top surface of the substrate 10, and the feed line L2 is disposed on the bottom surface of the substrate 10. The dual-band antenna 600 further includes a via hole V which connects the top and bottom surfaces of the substrate 10. Therefore, the feed line L2 disposed on the bottom surface of the substrate 10 can be electrically connected to the meander-shaped conductor M2 disposed on the top surface of the substrate 10 through the via hole V. In FIGS. 9*a* and 9*b*, the meander-shaped conductors M1 and M2 of the dual-band antenna 600 are disposed in the reciprocating bend manner as depicted in FIGS. 1*a* and 1*b*, but can also be disposed in the reciprocating bend manners as depicted in FIGS. 5*a*-7*a* and 5*b*-7*b*, or in other reciprocating bend manners.

Figure 10A:
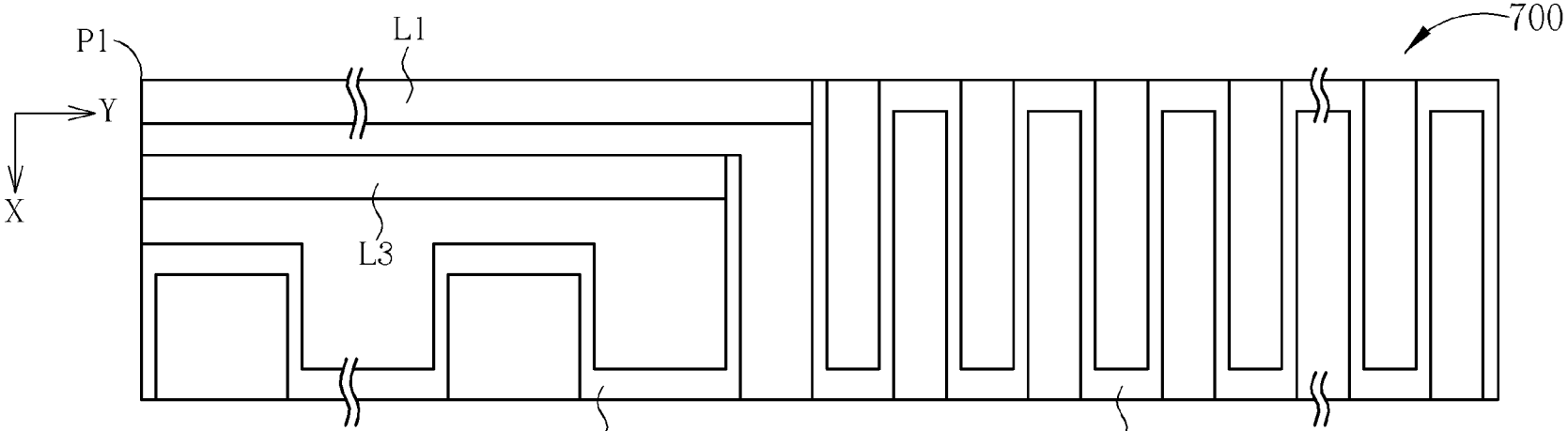
FIGS. 10*a* and 10*b* are planar diagrams of a multi-band antenna according to a seventh embodiment of the present invention.
Figure 10B:
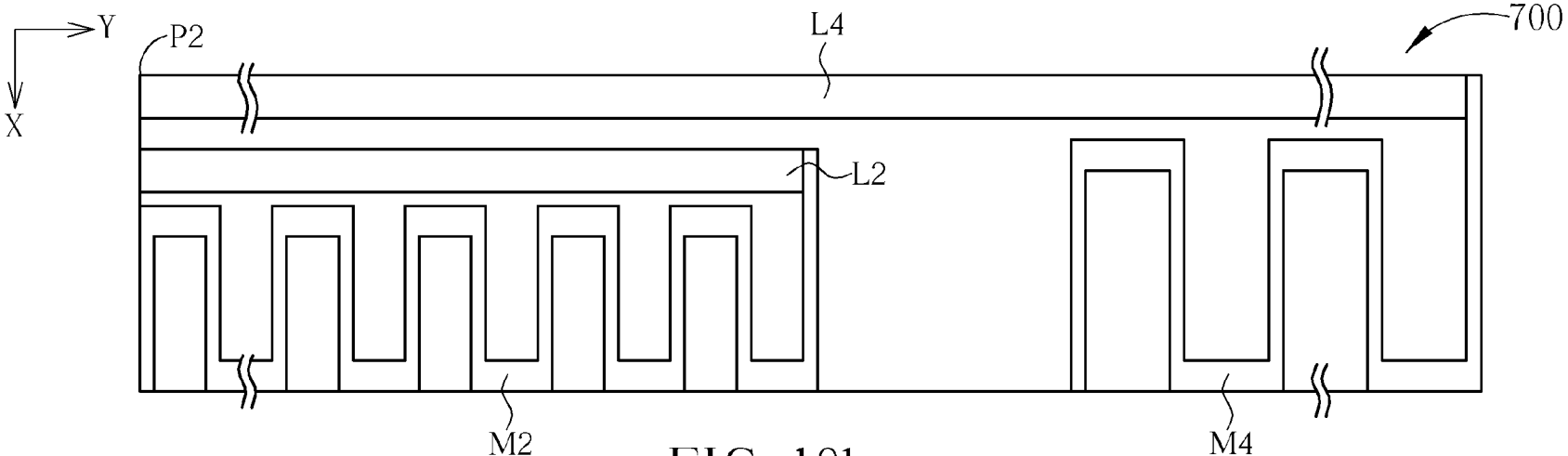

In the first through sixth embodiments of the present invention, the meander-shaped conductors M1 and M2 of the dual-band antennas 100-600 are electrically connected to the feed points P1 and P2 respectively via the feed lines L1 and L2 for receiving signals fed from the coaxial line 15, thereby providing two distinct resonant frequency bands corresponding to the operating frequencies F1 and F2, respectively. However, the present invention can also provide multiple distinct resonant frequency bands corresponding to more operating frequencies. References are made to FIGS. 10*a* and 10*b* for planar diagrams of a multi-band antenna 700 according to a seventh embodiment of the present invention. FIG. 10*a* is a top-view diagram of the multi-band antenna 700, while FIG. 10*b* is a bottom-view diagram of the multi-band antenna 700. Compared to the dual-band antennas 100-600 according to the first through sixth embodiments of the present invention, the multi-band antenna 700 further includes two meander-shaped conductors M3, M4 and two feed lines L3, L4. The meander-shaped conductor M3 and its corresponding feed line L3 are disposed on the top surface of the substrate 10, while the meander-shaped conductor M4 and its corresponding feed line L4 are disposed on the bottom surface of the substrate 10. The meander-shaped conductors M1-M4 have periodically-varying zigzag patterns, wherein the length, width or reciprocating widths of the conductors are determined according to the operating frequencies F1-F4. The overall lengths of the meander-shaped conductors M1-M4 are odd multiples of (¼)λ1-(¼)λ4, respectively. As a result, the present invention can provide four distinct resonant frequency bands F1-F4 when applied in a quad-band wireless communication system. The multi-band antenna 700 illustrated in FIGS. 10*a* and 10*b* is a quad-band antenna. By disposing more meander-shaped conductors on the top and bottom surfaces of the substrate 10 indifferent reciprocating bend manners, the multi-band antenna 700 can also provide more resonant frequency bands. Also, the meander-shaped conductors M1-M4 of the multi-band antenna 700 can be disposed in the reciprocating bend manner as depicted in FIGS. 1*a*, 1*b*, 5*a*-7*a* and 5*b*-7*b*, or in other reciprocating bend manners.

Figure 11A:
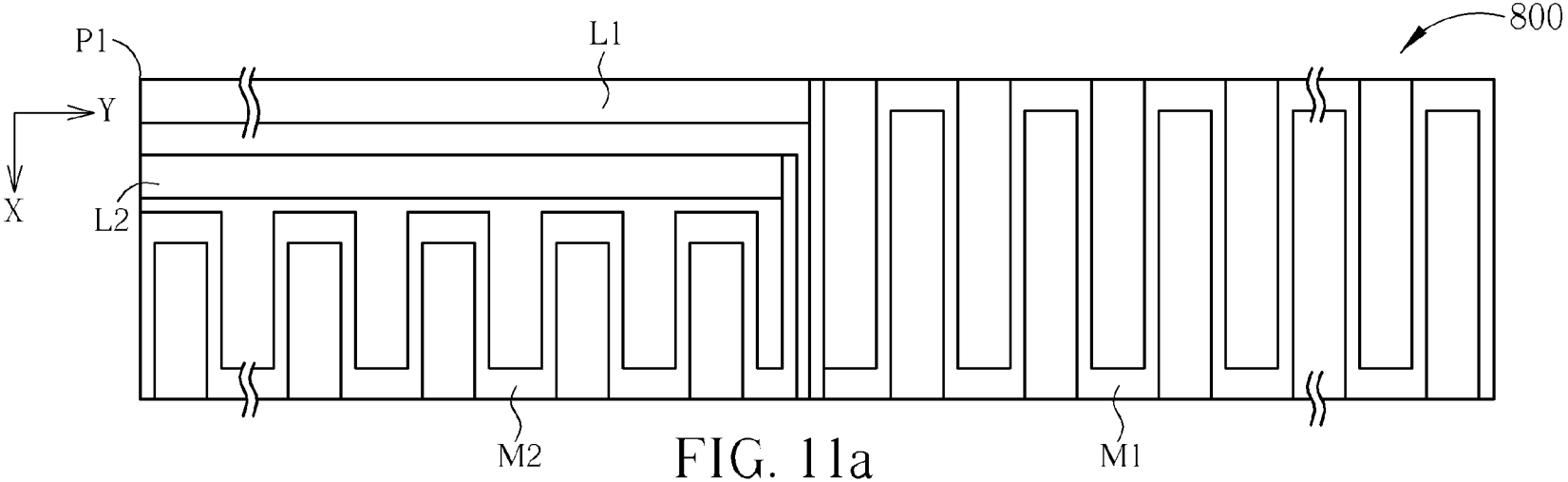
FIGS. 11*a* and 11*b* are planar diagrams of a dual-band antenna according to an eighth embodiment of the present invention.
Figure 11B:
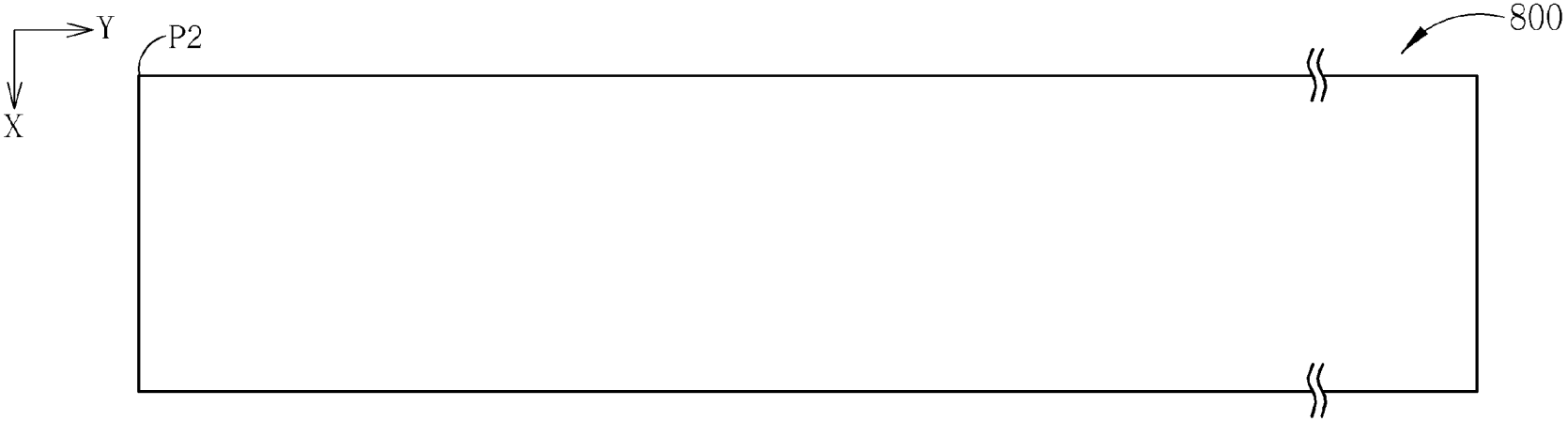

In the first through seventh embodiments of the present invention, the antennas 100-700 adopt a two-side substrate 10 having a top surface and a bottom surface for disposing the meander-shaped conductors. However, the present invention can also adopt other types of substrates. References are made to FIGS. 11*a* and 11*b* for planar diagrams of a dual-band antenna 800 according to an eighth embodiment of the present invention. FIG. 11*a* is a top-view diagram of the dual-band antenna 800, while FIG. 11*b* is a bottom-view diagram of the dual-band antenna 800. The dual-band antenna 800 adopts a single-side substrate 10 in which the meander-shaped conductors can only be disposed on the top surface. Compared to the first through seventh embodiments of the present invention, the meander-shaped conductors M1, M2 and the feed lines L1, L2 are disposed on the same surface of the substrate 10. The meander-shaped conductor M1 with overall length S1 and the meander-shaped conductor M2 with overall length S2 are both disposed in a reciprocating bend manner for providing two distinct resonant frequency bands in a dual-band wireless communication system. Also, the meander-shaped conductors M1 and M2 of the dual-band antenna 800 can be disposed in the reciprocating bend manner as depicted in FIGS. 1*a*, 1*b*, 5*a*-7*a* and 5*b*-7*b*, or in other reciprocating bend manners. Meanwhile, by disposing more meander-shaped conductors on the top surface of the single-side substrate 10 in different reciprocating bend manners, the antenna 800 can also provide more resonant frequency bands.

Figure 12:
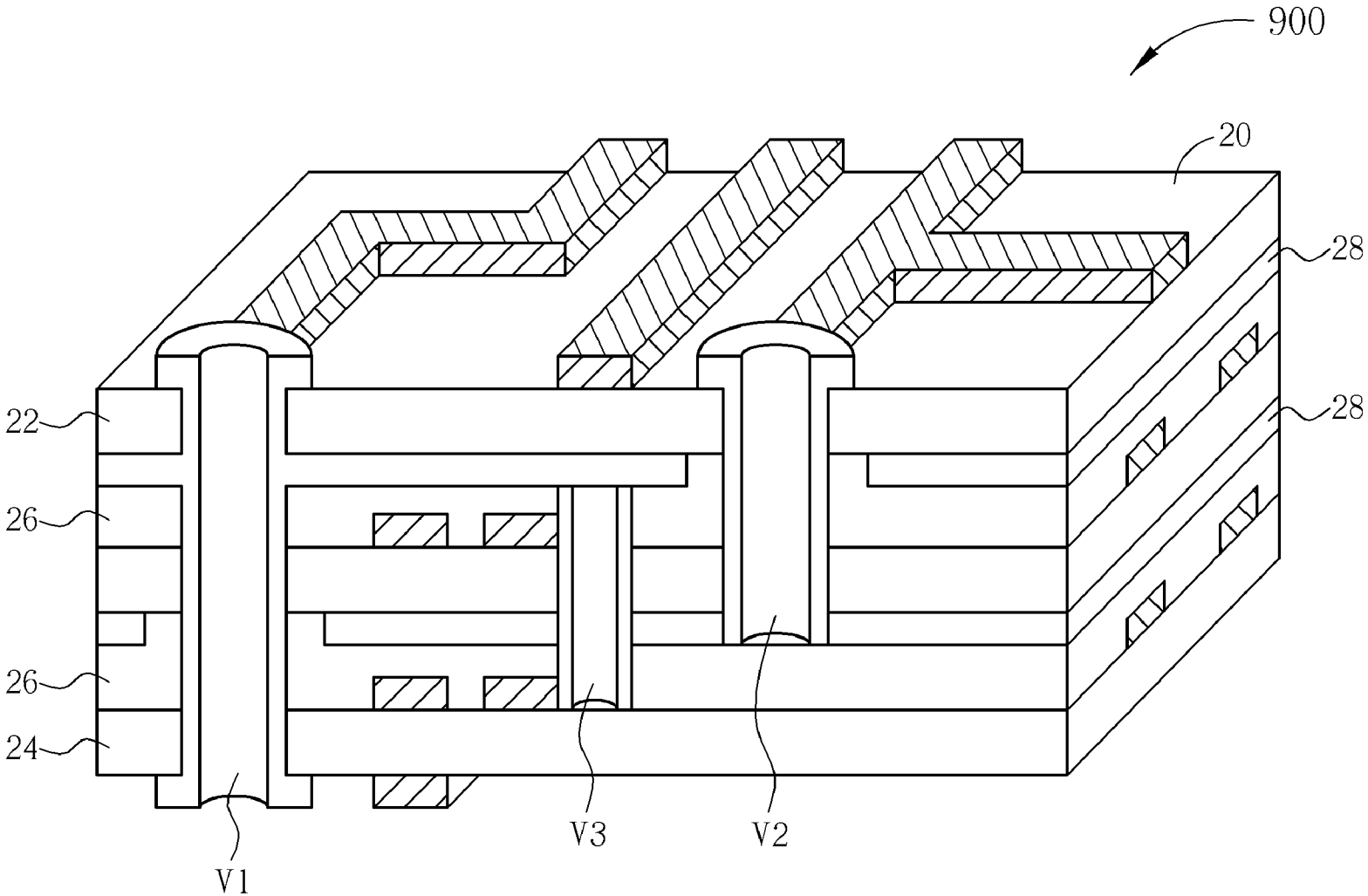
FIG. 12 is a diagram of a multi-band antenna according to a ninth embodiment of the present invention.

References are made to FIG. 12 for a planar diagram of a multi-band antenna 900 according to a ninth embodiment of the present invention. The multi-band antenna 900 adopts a multi-layer (a 6-layer structure is depicted in FIG. 12 for illustrative purpose) substrate 20 comprising a top layer 22, a bottom layer 24, two mid-layers 26, and two internal planes 28. The meander-shaped conductors and the feed lines can be disposed on the top surface of the top layer 22, the bottom surface of the bottom layer 24, and the mid-layers 26. The internal planes 28, generally consisting of large copper films, are mainly used as power layers or ground layers. Various via holes are disposed in the substrate 20 for connecting different layers. For example, a through via hole V1 connects the top layer 22 with the bottom layer 24, a blind via hole V2 connects the top layer 22 with one of the mid-layers 26 or connects one of the mid-layers 26 with the bottom layer 24, and a buried via hole V3 connects the two mid-layers 26. Based on system requirement, the meander-shaped conductors with various overall lengths and the corresponding feed lines (represented by dotted objects in FIG. 12) can be disposed on each layer in a reciprocating bend manner, as in the first through seventh embodiments. The multi-band antenna 900 can provide multiple resonant frequency bands and better resistance to high frequency interference with a multi-layer structure.

Figure 13:
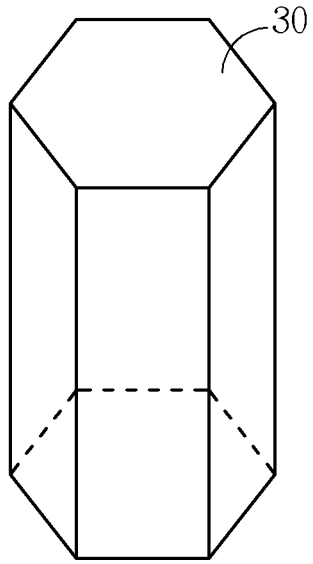
FIG. 13 is a diagram of a column-shaped substrate according to the present invention.
Figure 14:
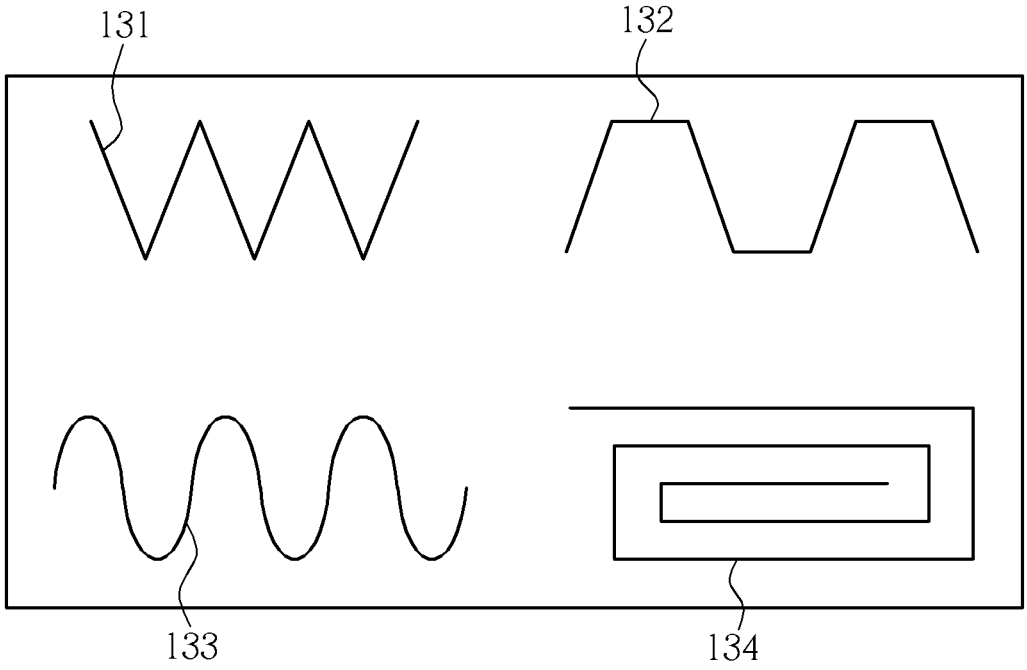
FIG. 14 is a diagram of various layouts of the meander-shaped conductor according to the present invention.

In the first through eighth embodiments of the present invention, the antennas 100-800 adopt a rectangular-shaped substrate 10. However, the present invention can also adopt substrates of other shapes, such as a column-shaped substrate 30 depicted in FIG. 13. The column-shaped substrate 30 includes a plurality of surfaces, and the substrate 30 depicted in FIG. 13 is a hexahedron for illustrative purpose. Based on system requirement, the meander-shaped conductors with various overall lengths and the corresponding feed lines can be disposed on a single surface or multiple surfaces of the column-shaped substrate 30 in a reciprocating bend manner, as in the first through seventh embodiments, thereby providing multiple resonant frequency bands corresponding to distinct operating frequencies.

In addition to the zigzag-shaped patterns in the above-mentioned embodiments, the meander-shaped conductors disposed in a reciprocating bend manner can have other patterns, such as a triangular layout 131, a trapezoid-shaped layout 132, a sinusoidal layout 133, a spiral layout 134, or other layouts combining the above-mentioned patterns. The patterns of the meander-shaped conductors illustrated in the figures are for illustrative purpose and do not limit the scope of the present invention.

Those skilled in the art will readily observe that numerous modifications and alterations of the device and method may be made while retaining the teachings of the invention.

What is claimed is:

1. A multi-band microstrip meander-line antenna comprising:

a substrate;

a first meander-shaped conductor disposed on the substrate in a first reciprocating bend manner for providing a resonant frequency band corresponding to a first frequency;

a second meander-shaped conductor disposed on the substrate in a second reciprocating bend manner for providing a resonant frequency band corresponding to a second frequency, wherein the first or the second meander-shaped conductor consists of a plurality of first sections disposed along a direction parallel to signal polarization and a plurality of second sections disposed along a direction perpendicular to signal polarization, and each first section is wider than each second section;

a first feed line having a first end electrically connected to a first feed point of the antenna and a second end electrically connected to an end of the first meander-shaped conductor; and a second feed line having a first end electrically connected to a second feed point of the antenna and a second end electrically connected to an end of the second meander-shaped conductor.

2. The antenna of claim 1 wherein a length of the first meander-shaped conductor is substantially equal to an integer multiple of a quarter wavelength of a signal at the first frequency which is connected to the first feed line, and a length of the second meander-shaped conductor is substantially equal to an integer multiple of a quarter wavelength of a signal at the second frequency which is connected to the second feed line.

3. The antenna of claim 1 wherein a length of the first meander-shaped conductor is substantially equal to an odd multiple of a quarter wavelength of a signal at the first frequency which is connected to the first feed line, and a length of the second meander-shaped conductor is substantially equal to an odd multiple of a quarter wavelength of a signal at the second frequency which is connected to the second feed line.

4. The antenna of claim 1 wherein the first meander-shaped conductor disposed on the substrate in the first reciprocating bend manner has a periodically-varying layout, and the second meander-shaped conductor disposed on the substrate in the second reciprocating bend manner has a periodically-varying layout.

5. The antenna of claim 1 wherein the first meander-shaped conductor disposed on the substrate in the first reciprocating bend manner has a spiral layout, and the second meander-shaped conductor disposed on the substrate in the second reciprocating bend manner has a zigzag-shaped, a trapezoid-shaped, a sinusoidal or a spiral layout.

6. The antenna of claim 1 wherein the first or the second feed line is disposed along the direction parallel to signal polarization.

7. The antenna of claim 1 wherein the first meander-shaped conductor and the first feed line are disposed on a first surface of the substrate, and the second meander-shaped conductor and the second feed line are disposed on a second surface of the substrate.

8. The antenna of claim 7 further comprising:

a third meander-shaped conductor disposed on the first surface of the substrate for providing a resonant frequency band corresponding to a third frequency; and a third feed line having a first end electrically connected to the first feed point and a second end electrically connected to an end of the third meander-shaped conductor.

9. The antenna of claim 8 wherein the third meander-shaped conductor is disposed on the first surface of the substrate in the first reciprocating bend manner.

10. The antenna of claim 8 further comprising:

a fourth meander-shaped conductor disposed on the second surface of the substrate for providing a resonant frequency band corresponding to a fourth frequency; and a fourth feed line having a first end electrically connected to the second feed point and a second end electrically connected to an end of the fourth meander-shaped conductor.

11. The antenna of claim 10 wherein the fourth meander-shaped conductor is disposed on the first surface of the substrate in the second reciprocating bend manner.

12. The antenna of claim 10 wherein a length of the third meander-shaped conductor is substantially equal to an integer multiple of a quarter wavelength of a signal at the third frequency which is connected to the third feed line, and a length of the fourth meander-shaped conductor is substantially equal to an integer multiple of a quarter wavelength of a signal at the fourth frequency which is connected to the fourth feed line.

13. The antenna of claim 10 wherein a length of the third meander-shaped conductor is substantially equal to an odd multiple of a quarter wavelength of a signal at the third frequency which is connected to the third feed line, and a length of the fourth meander-shaped conductor is substantially equal to an odd multiple of a quarter wavelength of a signal at the fourth frequency which is connected to the fourth feed line.

14. The antenna of claim 10 wherein the third or the fourth meander-shaped conductor includes a plurality of first sections disposed along the direction parallel to signal polarization direction and a plurality of second sections disposed along the direction perpendicular to signal polarization.

15. The antenna of claim 14 wherein each first section is wider than each second section.

16. The antenna of claim 7 wherein the substrate further comprises an nth surface, and the antenna further comprises:

an nth meander-shaped conductor disposed on the substrate in an nth reciprocating bend manner for providing a resonant frequency band corresponding to an nth frequency; and an nth feed line having a first end electrically connected to the first or the second feed point and a second end electrically connected to an end of the nth meander-shaped conductor, wherein n is an integer larger than two.

17. The antenna of claim 16 further comprising a via hole through which the second end of the nth feed line is electrically connected to the nth meander-shaped conductor.

18. The antenna of claim 16 wherein a length of the nth meander-shaped conductor is substantially equal to an integer multiple of a quarter wavelength of a signal at the nth frequency which is connected to the nth feed line.

19. The antenna of claim 16 wherein a length of the nth meander-shaped conductor is substantially equal to an odd multiple of a quarter wavelength of a signal at the nth frequency which is connected to the nth feed line.

20. The antenna of claim 16 wherein the nth meander-shaped conductor disposed on the substrate in the nth reciprocating bend manner has a periodically-varying layout.

21. The antenna of claim 16 wherein the nth meander-shaped conductor disposed on the substrate in the nth reciprocating bend manner has a zigzag-shaped, a trapezoid-shaped, a sinusoidal or a spiral layout.

22. The antenna of claim 16 wherein the nth feed line is disposed along the direction parallel to signal polarization.

23. The antenna of claim 16 wherein the nth meander-shaped conductor includes a plurality of first sections disposed along the direction parallel to signal polarization and a plurality of second sections disposed along the direction perpendicular to signal polarization.

24. The antenna of claim 23 wherein each first section is wider than each second section.

25. The antenna of claim 1 wherein the first meander-shaped conductor, the second meander-shaped conductor, the first feed line and the second feed line are disposed on a same surface of the substrate.

26. The antenna of claim 25 wherein the first and second feed points are located in the same place.

27. The antenna of claim 25 wherein the substrate is a single-layer substrate.

28. The antenna of claim 1 wherein the first meander-shaped conductor, the second meander-shaped conductor and the first feed line are disposed on a first surface of the substrate, and the second feed line is disposed on a second surface of the substrate.

29. The antenna of claim 28 further comprising a via hole through which the second end of the second feed line is electrically connected to the second meander-shaped conductor.

30. The antenna of claim 28 wherein the substrate further comprises an nth surface, and the antenna further comprises:

an nth meander-shaped conductor disposed on the substrate in an nth reciprocating bend manner for providing a resonant frequency band corresponding to an nth frequency; and an nth feed line having a first end electrically connected to the first or the second feed point and a second end electrically connected to an end of the nth meander-shaped conductor, wherein n is an integer larger than two.

31. The antenna of claim 30 further comprising a via hole through which the second end of the nth feed line is electrically connected to the nth meander-shaped conductor.

32. The antenna of claim 30 wherein a length of the nth meander-shaped conductor is substantially equal to an integer multiple of a quarter wavelength of a signal at the nth frequency which is connected to the nth feed line.

33. The antenna of claim 30 wherein a length of the nth meander-shaped conductor is substantially equal to an odd multiple of a quarter wavelength of a signal at the nth frequency which is connected to the nth feed line.

34. The antenna of claim 30 wherein the nth meander-shaped conductor disposed on the substrate in the nth reciprocating bend manner has a periodically-varying layout.

35. The antenna of claim 30 wherein the nth meander-shaped conductor disposed on the substrate in the nth reciprocating bend manner has a zigzag-shaped, a trapezoid-shaped, a sinusoidal or a spiral layout.

36. The antenna of claim 30 wherein the nth feed line is disposed along the direction parallel to signal polarization.

37. The antenna of claim 30 wherein the nth meander-shaped conductor includes a plurality of first sections disposed along the direction parallel to signal polarization and a plurality of second sections disposed along the direction perpendicular to signal polarization.

38. The antenna of claim 37 wherein each first section is wider than each second section.

39. The antenna of claim 1 wherein the first meander-shaped conductor, the first feed line and the second feed line are disposed on a first surface of the substrate, and the second meander-shaped conductor is disposed on a second surface of the substrate.

40. The antenna of claim 39 further comprising a via hole through which the second end of the second feed line is electrically connected to the second meander-shaped conductor.

41. The antenna of claim 39 wherein the substrate further comprises an nth surface, and the antenna further comprises:

an nth meander-shaped conductor disposed on the substrate in an nth reciprocating bend manner for providing a resonant frequency band corresponding to an nth frequency; and an nth feed line having a first end electrically connected to the first or the second feed point and a second end electrically connected to an end of the nth meander-shaped conductor, wherein n is an integer larger than two.

42. The antenna of claim 41 further comprising a via hole through which the second end of the nth feed line is electrically connected to the nth meander-shaped conductor.

43. The antenna of claim 41 wherein a length of the nth meander-shaped conductor is substantially equal to an integer multiple of a quarter wavelength of a signal at the nth frequency which is connected to the nth feed line.

44. The antenna of claim 41 wherein a length of the nth meander-shaped conductor is substantially equal to an odd multiple of a quarter wavelength of a signal at the nth frequency which is connected to the nth feed line.

45. The antenna of claim 41 wherein the nth meander-shaped conductor disposed on the substrate in the nth reciprocating bend manner has a periodically-varying layout.

46. The antenna of claim 41 wherein the nth meander-shaped conductor disposed on the substrate in the nth reciprocating bend manner has a zigzag-shaped, a trapezoid-shaped, a sinusoidal or a spiral layout.

47. The antenna of claim 41 wherein the nth feed line is disposed along the direction parallel to signal polarization.

48. The antenna of claim 41 wherein the nth meander-shaped conductor includes a plurality of first sections disposed along the direction parallel to signal polarization and a plurality of second sections disposed along the direction perpendicular to signal polarization.

49. The antenna of claim 48 wherein each first section is wider than each second section.

50. The antenna of claim 1 wherein the substrate includes dielectric, ceramic, glass, magnetic or high molecule material.

51. The antenna of claim 1 wherein the substrate includes a rigid printed circuit board (RPCB) or a flexible printed circuit board (FPCB).

52. The antenna of claim 1 wherein the substrate is a multi-layer substrate.

53. The antenna of claim 1 wherein the substrate has a hexahedron shape with multiple surfaces.

54. The antenna of claim 1 wherein the meander-shaped conductors include conductive material.

55. The antenna of claim 1 wherein the feed lines include conductive material.

* * * * *